US005419550A

United States Patent [19]

Blom

[11] Patent Number: 5,419,550

[45] Date of Patent: May 30, 1995

[54] TETHERED BALL BATTING PRACTICE DEVICE

[76] Inventor: Arthur W. Blom, 566 32 5/8 Rd., Clifton, Colo. 81520

[21] Appl. No.: 42,809

[22] Filed: Apr. 5, 1993

[51] Int. Cl.[6] ..... A63B 69/40

[52] U.S. Cl. ..... 273/26 E; 273/29 A; 273/58 C

[58] Field of Search ..... 273/26 E, 29 A, 58 C

[56] References Cited

U.S. PATENT DOCUMENTS

| | | | |
|---|---|---|---|
| 708,573 | 9/1902 | Miles | 273/26 E |
| 2,247,072 | 6/1941 | Stow | 273/29 A |
| 3,475,026 | 10/1969 | Cooper | 273/26 E |
| 3,825,359 | 7/1974 | Burchett | 273/29 A |
| 4,322,075 | 3/1982 | Hynes | 273/26 E |
| 4,632,394 | 12/1986 | Ryan | 273/29 A |
| 4,735,413 | 4/1988 | Yamanouchi | 273/58 C |
| 4,966,367 | 10/1990 | Oyarzabal | 273/26 E |
| 5,040,791 | 8/1991 | Ratajal | 273/29 A |
| 5,072,937 | 12/1991 | Zarate | 273/26 E |

*Primary Examiner*—Theatrice Brown
*Attorney, Agent, or Firm*—Donald W. Margolis

[57] ABSTRACT

A ball batting practice and training device comprised of a frame having a top and a bottom defining a vertical axis between them, and a pair of vertical support elements spaced from the vertical axis and from another. The frame carries a continuous circuit of line comprised of a first section of non-elastic line which slides through the top and the bottom of the frame defining a substantially vertical axis, and which non-elastic line is connected at both of its ends to a section of elastic line. The section of elastic line is connected to one of the vertical support elements to hold it in position. A to-be-batted ball is tethered to the first section of non-elastic line intermediate to the top and bottom of the frame, and may be selectively positioned at various heights along the vertical axis. A second non-elastic line is connected in series between the first vertical support element, the ball, and the second vertical support element. When batted, the ball is propelled a short distance within the framework of the device, causing the elastic portion of the circuit line to initially lengthen. When the energy of the batted ball is dissipated, the elastic portion of the circuit line then contracts, pulling on both ends of the non-elastic line and causing it to become taut, thereby almost immediately stopping and returning the tethered ball to its original position, ready to be batted again.

8 Claims, 3 Drawing Sheets

FIG. 3
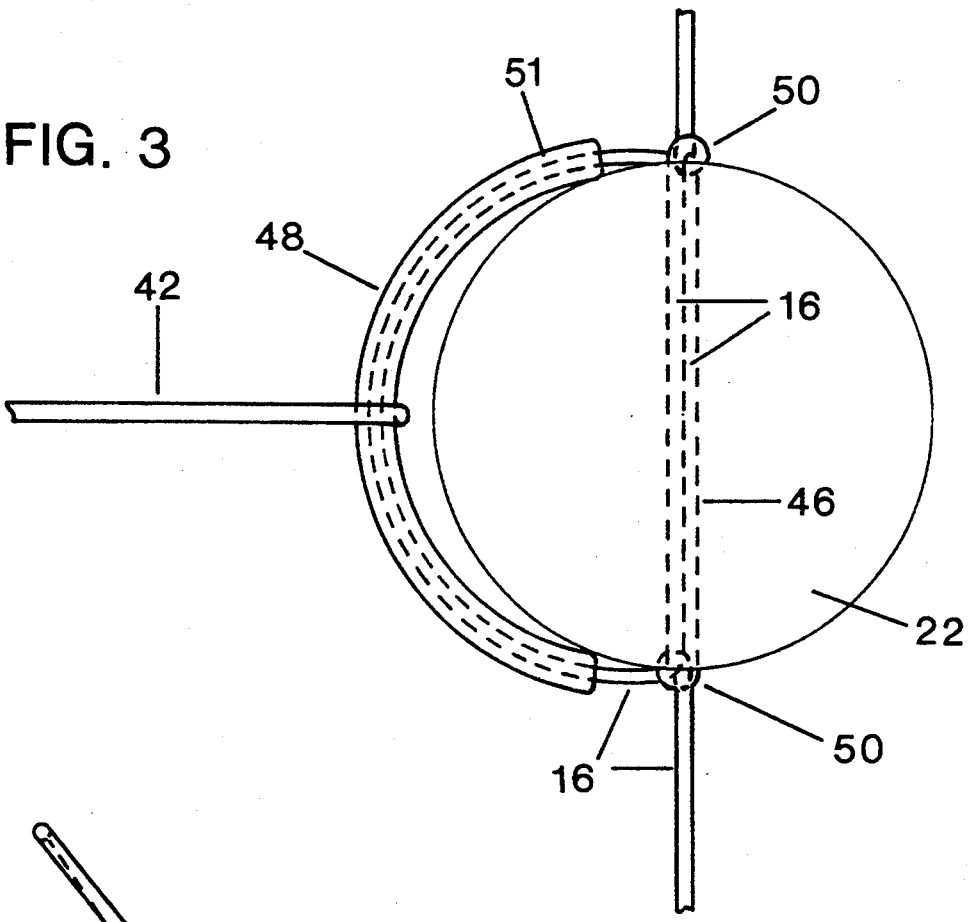
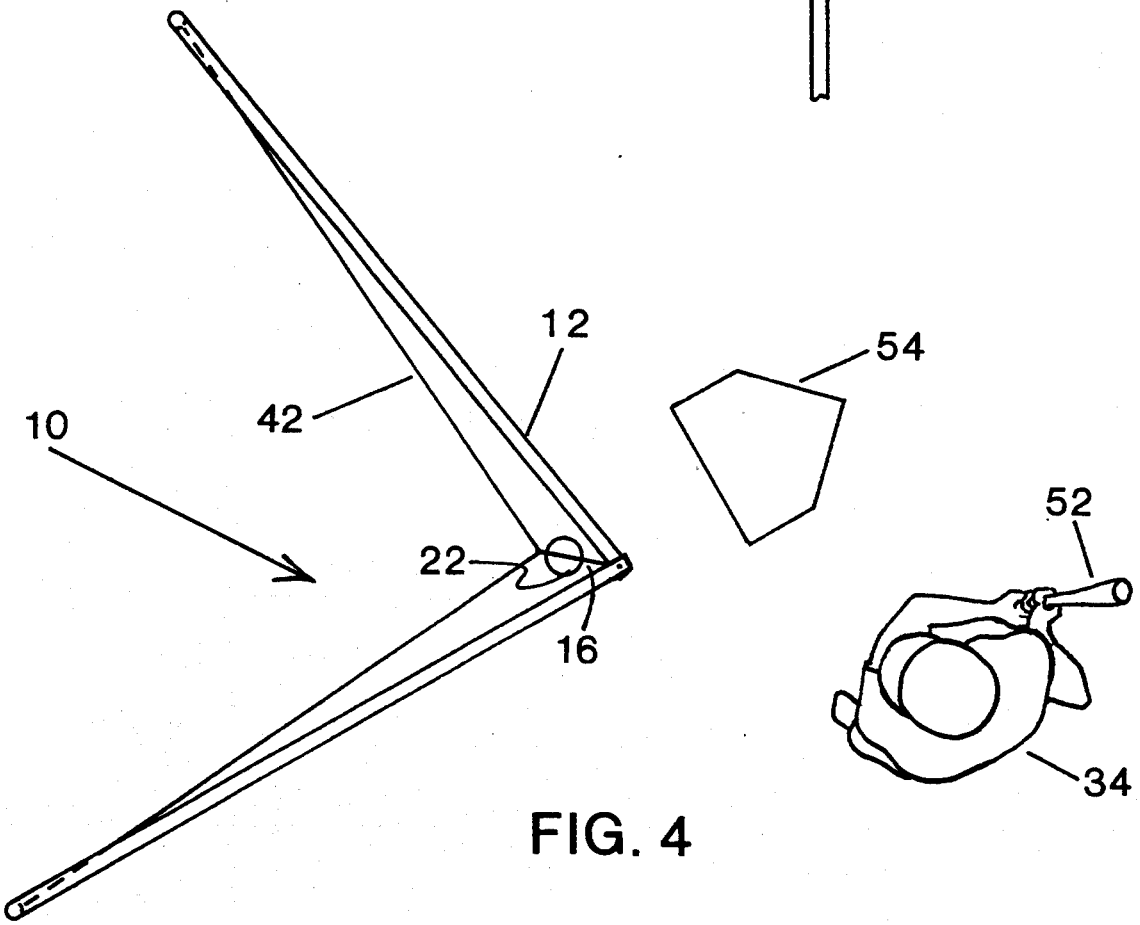
FIG. 4

TETHERED BALL BATTING PRACTICE DEVICE

BACKGROUND OF THE INVENTION;

1.Field of the Invention

This invention relates to an amusement device or game in the form of batting practice device having a tethered baseball.

2. Description of the Prior Art

The technique of hitting a moving target, for example a small spherical ball, such as a baseball or softball, with a club, such as a long, tapered bat has long been considered an art and is perhaps the most difficult of all sports skills to master. From the origination of the game of baseball to the present time there exists numerous and diverse theories, training methods, and techniques regarding the art of batting. Stemming from this interest numerous practice devices have been devised.. Many of these have been considered worthy of recognition and have been issued patents by the United. States Patent Office. Among them is U.S. Pat. No. 5,135,219 to McKeon, et al. which discusses in great detail the need for a practical device to develop batting skills, but like other prior art devices, it is deficient in one or more areas. Closely related prior art is taught in U.S. Pat. Nos. 5,048,828 to Love, and 4,322,075 to Hynes. In each of these references, the training device is basically a tethered ball on a non-elastic, flexible cord suspended from above. When hit the tethered ball wraps the cord about a vertical pole, and then slowly unwraps and oscillates to rest before the ball can be properly hit again. These devices are deficient in several ways. They do not adequately simulate the actual position of a pitched ball, and require a substantial wait between proper training swings. When using these devices, and the ball is missed by the swing of a bat, the cord could easily wrap about the bat, posing a possible danger to the user, or the cord may easily become entangled and cause more delay. Additionally, in the use of these devices, the path of the ball is outside the perimeter of the device, and may pose a threat to nearby persons.

U.S. Pat. No. 4,735,413 to Yamanouchi, et al.; U.S. Pat. No. 4,867,448 to Judd; and U.S. Pat. No. 4,966,367 to Oyarzabal are each based on the use of elastic cord with a ball tethered intermediately along a vertical cord. In each of these prior art devices, after being struck, the tethered ball may take an uncontrollable route upon return, and thereby cause a threat to the user. As with the other prior art, they also require a delay between swings. Another deficiency in these references is that changing the height of the ball is not an easy task.

It is therefore clear that none of the noted prior art baseball batting training devices provide, in combination, a device which positions a baseball to simulate the actual location of a pitched ball, in which the baseball is easily adjusted to varying heights for users of various sizes or simulating pitches at various heights, and which also do not require a substantial wait between proper training swings. Additionally, most of the prior art baseball batting training devices fail to provide, in combination, such a tethered ball device, which when the ball is missed by the swing of a bat, avoid having the tethering cord become entangled with the bat or with the supporting structure, and thereby causing delay. Other of these devices allow the path of the tethered hit ball to travel outside of the perimeter of the device, thereby posing a threat to nearby persons, or after being struck, allow the tethered ball to take an uncontrollable route upon return, and thereby cause a threat to the user. Many other prior art practice batting devices are deficient in that they are bulky, not easily transportable, impractical, expensive, and unrealistic in a number of ways; and, therefore, are impractical for widespread public use.

SUMMARY OF THE INVENTION

It is therefore an object of the present invention to provide a practical, feasible, and safe practice and training device for improvement of the batting skills of a user.

It is another object of the present invention to provide a baseball batting training device which is designed for use by individuals of any age, ability, and level of skill.

It is yet another object of the present invention to provide a practice baseball batting training device which a user will be able to use to develop hand-eye coordination, work on batting stance, swing, follow-through, and tone muscle used in the bodily act of swinging a bat.

Another object of this invention is to provide a reliable device that allows a solo batter to physically practice batting a real ball without seeking another person to pitch, catch or shag balls.

It is another object of this invention to provide a baseball batting training device which provides, in combination, a device which easily allows a baseball to be positioned to simulate the actual location of a pitched ball, and in which the baseball is easily adjusted to varying heights for users of various sizes, or for simulating pitches at various heights.

Still yet another object of the present invention is to provide such a baseball batting training device which does not require a substantial wait between proper training swings due to the baseball becoming entangled with the bat or with the supporting structure, or not coming to rest, all of which cause delays.

Another object of this invention is to provide a baseball batting training device which does not allow the path of the tethered hit ball to travel outside of the perimeter of the device, or which, after being struck, allows the tethered ball to take an uncontrollable route upon return, thereby avoiding a danger to nearby persons, and to the user.

The ball batting practice and training device of the present invention is comprised of a frame having a top and a bottom defining a vertical axis between them, and a pair of vertical support elements spaced from the vertical axis and from another. In preferred embodiments the frame is in the form of two connected "C" shaped halves which are joined at their open ends to form a butterfly shape, with the points of joining defining the top and bottom of the frame, and the backs of the "C"s forming the vertical support elements. The frame carries a continuous circuit of line comprised of a first section of non-elastic line which slides through the top and the bottom of the frame defining a substantially vertical axis, and which non-elastic line is connected at both of its ends to a section of elastic line. The section of elastic line is connected to one of the vertical support elements to hold it in position. A to-be-batted ball is tethered to the first section of non-elastic line intermediate to the top and bottom of the frame, and may be selectively positioned at various heights along the vertical axis. A second non-elastic line is connected in series between the first vertical support element, the ball, and the second vertical support element. When batted, the ball is propelled a short distance within the framework of the device, causing the elastic portion of the circuit line to initially lengthen. When the energy of the batted ball is dissipated, the elastic portion of the circuit line then contracts, pulling on both ends of the non-elastic line and causing it to become taut, thereby almost immediately stopping and returning the tethered ball to its original position, ready to be batted again.

It is thus demonstrated that this invention presents the user with a ball to hit as often and frequently as desired with no need to recover, replace, or reposition the ball after any hit. All movement of the ball is arrested in less time than is normally required by a batter to reposition for another swinging. The ball may be placed at any level within the strike zone of the batter by simply moving the ball tip or down along the vertical axis. Danger to a batter as a result of missing the ball, or hitting a line with the bat, or by having the ball return to strike the batter has been all but eliminated. As the path of a batted ball is contained within the framework of the device, there is little chance of a bystander coming in contact with a batted a ball. The device and its frame body is compact and does not interfere with the normal batting position, stance, swing, or follow-through of a batter. The practice ball is presented for hitting with no obstructions and with almost no visual distraction to the batter so that the satisfaction of hitting a ball in free flight is nearly experienced.

These and other objects of the present invention will become apparent to those skilled in the art from the following detailed description, showing the contemplated novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which:

FIG. 3 is a detailed side view of the ball to illustrate the method for attaching cords to the ball.

FIG. 4 is a top view, similar to FIG. 1, and illustrating the configuration of the frame body and to show the proper position and relationship of the batter to the device, and a simulated home plate while the device is in use.

DETAILED DESCRIPTION OF THE PREFERRED EMBODIMENTS

Figure 1:
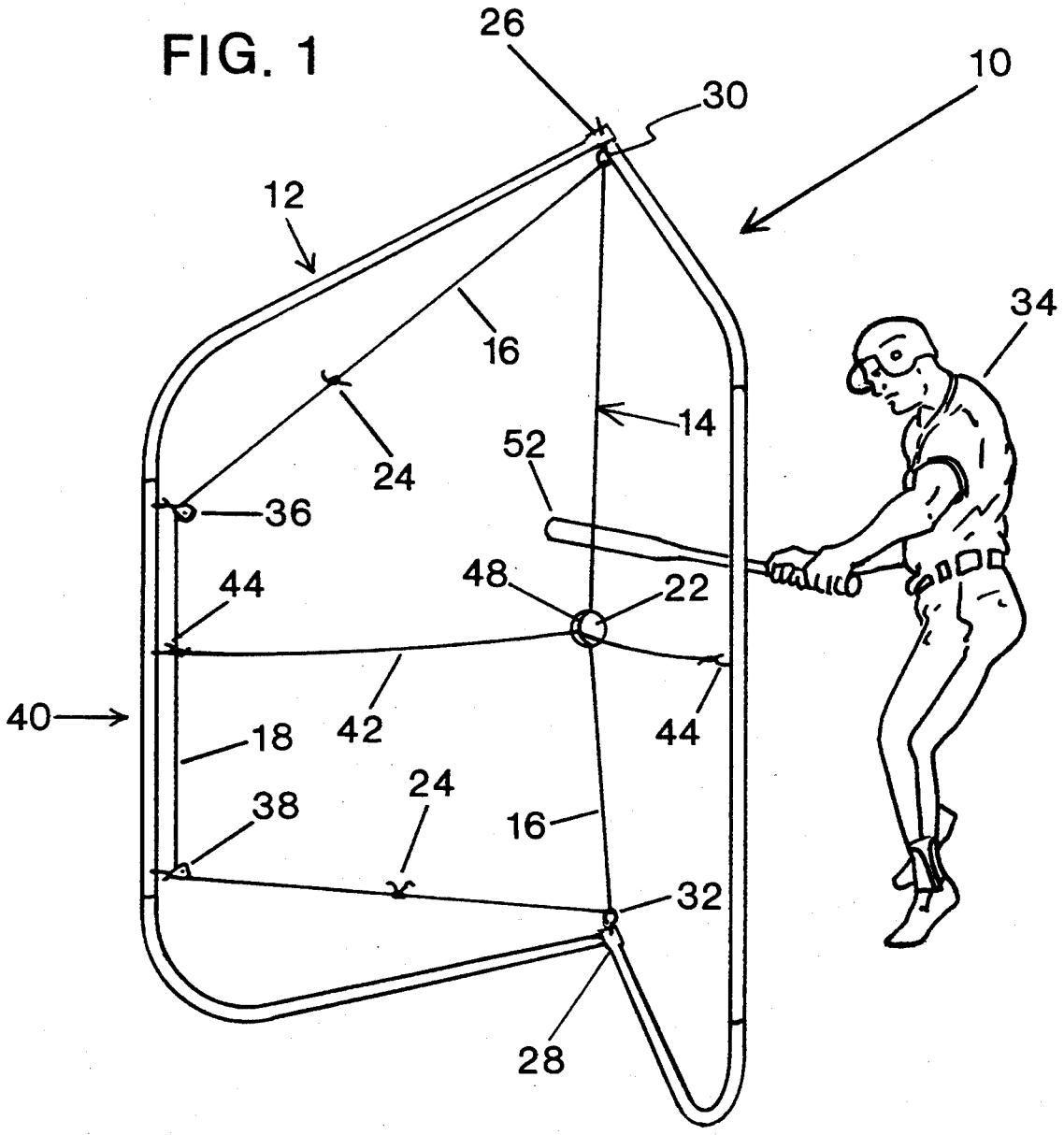
FIG. 1 is a rear perspective view of a batting device embodying the present invention showing a batter about to hit the ball portion of the device.

The same elements carry the same reference numbers in each figure. This ball batting device, generally 10 is composed of a multi-component support frame 12, a continuous circuit of line 14 composed of two sections 16 and 18, a retention line 42, and a ball 22.

Figure 2:
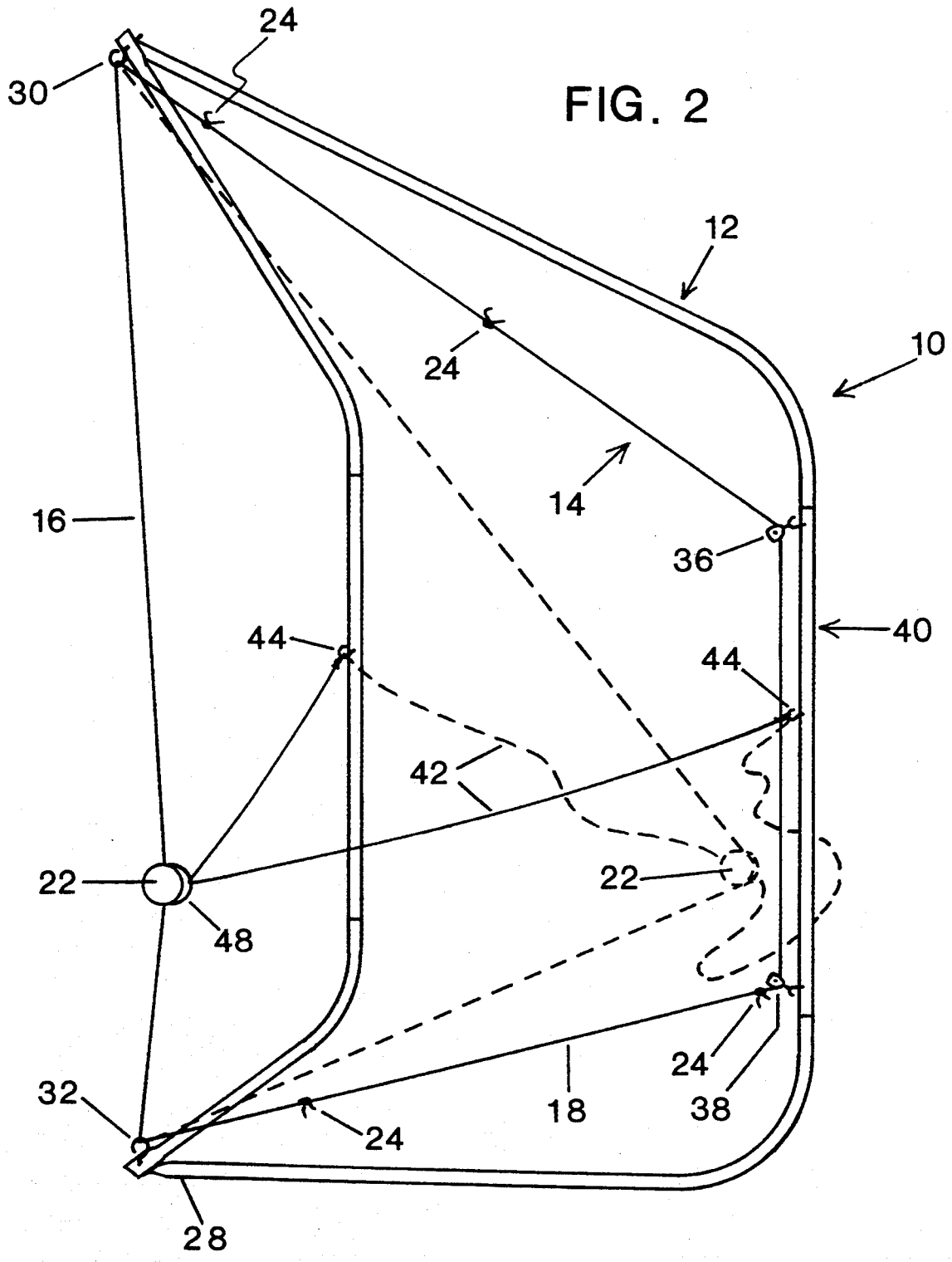
FIG. 2 is a side perspective view showing the batting device and illustrating the position of components prior to the ball being hit, as well as a representation of the position of the ball and line components after the ball has been hit and near its maximum flight extension.

As shown in FIGS. 1, 2 and 3 line section 16 is of a flexible non-elastic material, such as cord, rope, twine, cable, and the like. Line section 18 is of a flexible and elastic type material, such as rubber, bungee cord, elastic, and the like. In preferred embodiments, line section 18 has limit to its maximum stretchable length so as to keep ball 22 within the perimeter of frame 12, as detailed below. Non-elastic line type section 16 is united with elastic line type section 18 by splicing the ends together at their mating ends, for example, with knots 24, although traditional splicing techniques, plaiting, mechanical connectors, tape, and combinations thereof may be used.

The top 26 and bottom 28 of frame 12 each carry a guide 30 and 32, respectively. Guide 30 is attached to the upper apex 26 of frame 12, and is positioned at a height about the head of a user/batter 34. Guide 32 is attached to the lowest portion of bottom 28 of frame 12, adjacent to the ground level. Guides 30 and 32 may be screw-eyes, pulleys, and the like which will allow non-elastic line 16 to pass easily and smoothly through them, as described below. By reference to the figures, it is seen that the ends of non-elastic line 16 of continuous line circuit 14 are passed through guides 30 and 32 before they are connected to elastic line 18.

A second pair of guides 36 and 38, in this case shown as a pair of pulleys, are supported by a back portion 40 of frame 12. Elastic line section 18 traverses through pulleys 36 and 38. As shown, knots 24 tie the ends of line section 16 together with the ends of line section 18 intermediate to upper pulley 36 and upper guide 30, and intermediate lower pulley 38 and lower guide 32. The bulk of knot 24 is preferably of a size sufficient which will restrict it from passing through upper pulley 36 and lower pulley 38. Practice ball 22, which can be an actual regulation baseball or a softball, is attached to the vertical portion of non-elastic line section 16. This relationship can be used to select the height position of ball 22. When knot 24 is stopped against the pulley 36, the length of non-elastic line section 16 determines the maximum height position of ball 22 on its vertical axis, which is, for example, estimated to be the top of the strike zone of a tall adult batter 34. Likewise the lower knot 24 that ties the ends of non-elastic line section 16 together with elastic line section 18 transverses the intermediate distance between the lower pulley guide 38 and the lower screw-eye guide 32. When the bulk of the knot 24 is restricted from passing through lower pulley 38, the length of non-elastic line section 16 determines the extent of the lowest position of the ball 22 on its vertical axis. This height position is estimated to be at the low area of the strike zone for a small non-adult sized batter 34. In use, a batter 34 may selectively position the practice ball 22 anywhere along the intermediate range of the vertical axis simply by grasping ball 22 and moving it up or down.

The elastic line section 18 is of a specific length, but when positioned on device 10, is stretched when ball 22 is at rest on its vertical axis..As a result, non-elastic line 16 is under biasing tension, and both lines 16 and 18 are taut. The length and stretchable limit of line section 18 are selected to allow ball 22, when hit, to be propelled to a restricted maximum distance, preferably within the perimeter of frame 12, as shown in FIG. 2, before being almost immediately urged to its original position by the biasing nature of elastic line 18. For example, a commercially available bungee line 18, which is from about 1 foot to about 4 feet in length, more or less, when not stretched, is capable of being stretched to 30% to 200% of its length, and may be used in the practice of the present invention.

A lateral retention line 42 consists of a flexible non-elastic material, and may be of a similar composition as used for line section 16. A loop is tied into each end of retention line 42 for attachment onto hooks 44 formed on each of the two vertical back structures of frame 12. Hooks 44 are positioned at a height about midway between the maximum and the minimum areas of the ball selection height. The length of flexible retention line 42 between its ends and the ball 22 is determined to be slightly less than the sum of the length of each distance from the backside of the ball 22 to the two hooks 44. As a result that ball 22 is under constant lateral tension, and the vertical portion of non-elastic line 16 is slightly out of true vertical alignment between upper and lower guides 30 and 32, as best illustrated in FIG. 3. This deviation from a true vertical alignment will vary slightly as ball 22 is moved towards the top or towards the bottom of the allowable and selected height zone. The retention line 42 also acts as a restraint to the distance which ball 22 may be hit, and serve to assist in returning ball 22 to its origin between upper and lower guides 30 and 32, after ball 22 has been hit.

FIG. 3 shows the detail of the structure used to link the retention cords line 42 with ball 22 in a manner which enables ball 22 to both move freely, and to also readily find its ideal position of rest. As shown, ball 22 is secured to non-elastic line section 16 by first inserting one end of line 16 through an opening 46 that has been formed through the vertical axis of ball 22, and which is then formed into a loop 48 around one-half of the circumference of the ball 22, and is again inserted through the same opening 46 as before. Line 16 is then secured at both of the upper and lower ends of extremities, for example by knots 50 in order to prevent any change of tightening or loosening of loop 48. In preferred embodiments, any extra space or looseness inside of ball opening 46 after line 16 has been twice passed through it, may be filled with a self-curing cushioning and/or securing material such as a silicone or latex. This filling assures a snug and secure fit of the line 16 within ball 22, and also prevents potentially damaging moisture from entering the interior of the ball 22 through opening 46. Retention line 42 transverses freely through a gap created between the loop 48 and the surface of the ball 22. Loop 48 must have sufficient slack between it and ball 22 to so that there is space for retention line 42 to move uninhibitedly from side-to-side and up and down as necessitated by the motion of ball 22, both when it is hit and when it returns to its original position, regardless of the height at which the ball has been placed. Loop 48 of line 16 may be protected by encasing it within a tube 51 of durable material such as rubber, plastic, or metal. Protective tube 51 serves to protect line 16 against the abrasive wear caused by the continual yanking, pulling, and sliding effects between the loop 48 and retention line 42. Due to the manner in which loop 48 is secured to ball 22, ball 22 may be periodically rotated on its axis so that all of the surface portions of ball 22 may receive the impact from bat 52.

The frame body 12 may be assembled from sections of tubing for convenience of transporting. The basic shape of frame body 12 resembles a butterfly which is constructed of two "C" like halves, preferably connected at an acute angle being between about 45° and about 90°, although other angles may be used if frame 12 is secured to the ground. In preferred embodiments, frame 12 is comprised of multiple light sections, for example of hollow metal or plastic tubes, which can be easily disassembled for convenience of transportation to and from locations for batting practice use, at which they can then be easily and conveniently -assembled. It will be seen, by reference to the drawings, that each of the frame components have a top section, a bottom section, and a vertical support section to join the top section with the bottom section. The union of the vertical support section to the top section and to the bottom section will most conveniently have a sleeve fit, with the outside diameter of one end fitting into the inside diameter of its joining section. The connection is then maintained by friction, or by art known connecting devices, such as spring loaded buttons carried by one section and extending through holes in the joining section.

FIG. 4 provides a top view of the batting practice device of the present invention, and which illustrates the position for a right-handed batter 34 to stand in relation to the batting device and a simulated home plate 54. When struck, as shown in FIG. 2, ball 22 will be propelled and guided generally along the plane defined by retention line 42. A batter 34 should position his or her batting stance in front of and to his or her side of practice ball 22 so that when he or she swings and hits ball 22 it will be directed along the near side of the framework of the device. FIG. 4 shows the location of a home plate 54, in order to further illustrate the relationship of the batter to the strike zone. and to illustrate that the actual point of contact of bat 52 on ball 22 during a swing is slightly in front of plate 54, which simulates hitting a pitched ball before it actually reaches plate 54.

It is therefore clear that the baseball batting training device of the present invention provides, in combination, a device which positions a baseball to simulate the actual location of a pitched ball, in which the baseball is easily adjusted to varying heights for users of various sizes, and which also does not require a substantial wait between proper training swings. Additionally, the baseball batting training device of the present invention provides, in combination, such a tethered ball device, which when the ball is missed by the swing of a bat, avoids having the tethering cord become entangled with the bat or with the supporting structure, and thereby avoids delay. Furthermore the device of the present invention does not allow the path of the tethered hit ball to travel outside of the perimeter of the device, thereby avoiding a threat to nearby persons, and after being struck, does not allow the tethered ball to take an uncontrollable route upon return which may cause a threat to the user. In addition, the practice batting device of the present invention is not bulky, is easily transportable, is not expensive, and is therefore practical for widespread public use.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. A ball batting practice and training device comprised of:

a frame having a top and a bottom defining a vertical axis between them, and a pair of vertical support elements spaced from said vertical axis and each other;

a continuous circuit of line comprised of a first section of non-elastic line and a section of elastic line which are joined at their respective ends to form said continuous circuit of line which is carried by said frame, said first section of non-elastic line is guided through the top and the bottom of the frame to define a substantially vertical axis, the section of elastic line being connected to at least one of said vertical support elements to hold said section of elastic line in position;

a to-be-batted ball, said to-be-batted ball being tethered to the first section of non-elastic line intermediate to the top and bottom of the frame;

means to allow selective positioning of said to-be-batted ball to various heights along said vertical axis; and a second non-elastic line connected in series between said first vertical support element, said ball, and said second vertical support element; so that when batted, said ball is propelled a short distance substantially within said frame causing the elastic portion of the circuit line to initially lengthen, but when the energy of said batted ball is dissipated, said elastic portion of said circuit line then contracts, pulling on both ends of said non-elastic line and causing it to become taut, thereby almost immediately stopping and returning said tethered ball to its original position, ready to be batted again.

2. The ball batting practice and training device of claim 1 wherein said second non-elastic line is positioned at about waist height to a user.

3. The ball batting practice and training device of claim 1 wherein said second non-elastic line is in a plane which is substantially parallel to the ground.

4. A batting practice and training device for use with a ball and a bat, comprised of:

a frame, said frame having a top and bottom, defining between them a substantially vertical axis, and at least one support element spaced from said vertical axis;

a plurality of means for guiding a line, at least one said line guiding means carried by said the top of said frame, at least one said line guiding means carried by said bottom of said frame, and at least one said line guiding means carried by said support element;

a first flexible, non-elastic line having a first end and a second end and including means for tethering a ball located intermediate said first and second ends of said first flexible, non-elastic line;

a flexible, elastic line having a first and a second end, said first end of said flexible, elastic line being joined to said second end of said first flexible, non-elastic line, and said second end of said flexible, elastic line being joined to said first end of said first flexible, non-elastic line to form a continuous circuit of line in which an upper portion of said circuit of line is associated with and guided by said line guiding means carried by said top of said frame, a lower portion of said circuit of line is associated with and guided by said line guiding means carried by said bottom of said frame, and with a portion of said flexible, elastic line which is intermediate said first end and said second end of said flexible, elastic line is associated with and guided by said guiding means carried by said support element; and a second flexible, non-elastic line having a first and a second end, said first end of said second flexible, non-elastic line being connected to said means for tethering a ball, and said second end of said second flexible, non-elastic line being connected to said support element; whereby when a ball is carried by said means for tethering a ball, and such a ball is struck by a bat said flexible, elastic line becomes elongated and said ball and said first non-elastic line are caused to travel substantially within the perimeter of said frame and are then returned to their original position by the action of said flexible, elastic line upon said first non-elastic line and the action of said second non-elastic line upon such a ball, respectively.

5. The ball batting practice and training device of claim 4 wherein said frame includes a first and a second support element, each spaced from said vertical axis and spaced from one another, and wherein further, said second non-elastic line is connected in series between said first support element, said ball tethering means, and said second support element.

6. The ball batting practice and training device of claim 2 wherein said frame is in the form of two connected "C" shaped halves which are joined at their open ends at an angle, with the points of joining defining said top and said bottom of said frame, and the backs of the "C" shaped halves forming said first and second support elements.

7. The ball batting practice and training device of claim 6 wherein a ball is carried by said means for tethering a ball intermediate said first and second ends of said first flexible, non-elastic line.

8. The ball batting practice and training device of claim 4 wherein a ball is carried by said means for tethering a ball intermediate said first and second ends of said first flexible, non-elastic line.

* * * * *